US009663335B2

(12) United States Patent
Huang et al.

(10) Patent No.: US 9,663,335 B2
(45) Date of Patent: May 30, 2017

(54) HYDRAULIC WINCH CONTROL SYSTEM AND METHOD

(71) Applicant: Caterpillar Inc., Peoria, IL (US)

(72) Inventors: Peter Hsien Huang, Peoria, IL (US); Michael Thomas Jackson, Hanna City, IL (US); Ragavender Mailwar, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/470,278

(22) Filed: Aug. 27, 2014

(65) Prior Publication Data

US 2016/0060082 A1 Mar. 3, 2016

(51) Int. Cl.

| | |
|---|---|
| ***B66D 1/44*** | (2006.01) |
| ***B66D 1/08*** | (2006.01) |
| ***B66C 23/44*** | (2006.01) |
| *E03F 3/06* | (2006.01) |

(52) U.S. Cl.

CPC ..... *B66D 1/08* (2013.01); *B66C 23/44* (2013.01); *B66D 1/44* (2013.01); *E03F 3/06* (2013.01)

(58) Field of Classification Search

CPC ... B66D 1/40; B66D 1/08; B66D 1/14; B66D 5/00

USPC ..... 254/360

See application file for complete search history.

(56) References Cited

U.S. PATENT DOCUMENTS

| | | | | |
|---|---|---|---|---|
| 3,815,478 A | | 6/1974 | Axelsson et al. | |
| 3,871,714 A | | 3/1975 | Behrend | |
| 3,969,897 A | | 7/1976 | Humphreys et al. | |
| 3,972,185 A | | 8/1976 | Medina | |
| 4,048,799 A | | 9/1977 | Golan et al. | |
| 4,337,926 A | | 7/1982 | Dehaan | |
| 4,448,398 A | | 5/1984 | Wyatt | |
| 5,176,364 A | * | 1/1993 | Bell | B66D 1/08 254/291 |
| 5,992,655 A | * | 11/1999 | Greenberg | B66C 23/44 212/258 |
| 6,644,629 B1 | * | 11/2003 | Higashi | B66D 1/56 254/361 |
| 6,648,303 B1 | * | 11/2003 | Nishimoto | B66D 1/48 254/361 |
| 7,063,306 B2 | | 6/2006 | Sanders et al. | |

(Continued)

FOREIGN PATENT DOCUMENTS

| | | |
|---|---|---|
| EP | 1550774 | 3/2008 |

*Primary Examiner* — Emmanuel M Marcelo

(74) *Attorney, Agent, or Firm* — Miller, Matthias & Hull

(57) ABSTRACT

A hydraulic winch assembly uses a control algorithm that separates brake control from drum rotation to permit fine control of load position. Actuation of an operator interface to a first position displacement threshold will release a drum brake but will not activate a hydraulic pump for operating a hydraulic motor coupled to the drum until the operator interface is moved to a second position displacement threshold. During the operating condition when the brake is released but the pump is not operating, the force of a load applied to a cable coupled to the drum may cause the cable to slowly unwind from and rotate the drum, thereby permitting fine control of drum rotation. Additionally, when the pump is activated upon further movement of the operator interface, a speed of the motor may be modulated, such as by a gear ratio command, to permit precise control over lower drum speeds.

20 Claims, 5 Drawing Sheets

(56) References Cited

U.S. PATENT DOCUMENTS

| | | | | |
|---|---|---|---|---|
| 7,166,061 | B2 | 1/2007 | Shimomura et al. | |
| 7,192,010 | B2 | 3/2007 | Roodenburg et al. | |
| 2005/0072965 | A1* | 4/2005 | Sanders | B66D 1/485 254/361 |
| 2007/0098494 | A1 | 5/2007 | Mares | |
| 2008/0224112 | A1* | 9/2008 | Epplin | B66D 1/48 254/323 |
| 2011/0084044 | A1 | 4/2011 | Camacho et al. | |
| 2013/0311051 | A1* | 11/2013 | Torii | B66C 13/20 701/50 |

* cited by examiner

HYDRAULIC WINCH CONTROL SYSTEM AND METHOD

TECHNICAL FIELD

The present disclosure generally relates to hydraulic winches, and more particularly to systems and methods for controlling operation of hydraulic winches.

BACKGROUND

Hydraulic winches are used in a variety of operations to perform lifting, lowering, or towing operations. For example, pipelayers are specialized machines that use winches to install large, heavy lengths of conduit into or above ground. In some applications, the conduits are used to carry oil and gas from remote well locations over vast distances to a receiving station or refinery. The use of a pipeline avoids transportation costs for shipping, trucking, or otherwise moving the oil or gas. In addition to petroleum pipelines, pipelayers can also be used to install piping for other materials, or for installing drain tile, culverts, or other irrigation and drainage structure. In these applications, winches are used to lift, position, and/or lower heavy loads.

To provide sufficient power for heavy loads, many winches are hydraulically driven. Hydraulic winches typically include a drum about which is wound a cable. The drum is coupled to a hydraulic motor, which in turn is hydraulically coupled to a hydraulic pump. The hydraulic pump may be operatively coupled to an engine of the machine or other prime mover. A brake may also be provided that may normally engage and hold the drum in place, but may be disengaged to permit drum rotation. An operator interface, such as a lever, may be coupled to the pump and brake through a controller to enable a user to operate the winch.

Conventional control systems for hydraulic winches do not permit relative fine control of the load, particularly in lowering operations. Some conventional systems employ a counterbalance valve to address this issue, but the counterbalance valve adds a considerable amount of heat to the system during use, thereby necessitating additional flushing of the hydraulic circuit to maintain acceptable operating temperatures. If the counterbalance valve is removed from these systems, however, the brake is released simultaneously with operation of the pump, causing drum speed to be too aggressive and the load to overshoot the desired position before pump operation can be adjusted.

U.S. Pat. No. 7,166,061 to Shimomura et al. discloses a control device for a hydraulic winch having a hydraulic motor and a brake coupled to the winch. The control device uses a load pressure on the hydraulic motor and external command signals to adjust a capacity of the motor. When the control device executes an automatic shutoff, during which the brake is activated to hold the winch in place, it also increases the motor capacity sufficient to maintain the load, thereby to improve response time of the winch when the automatic shutoff is released. While response time may be improved, Shimomura does not address fine control of the winch when it begins to move from a halt position, particularly since the Shimomura control device increases motor capacity to match the load.

SUMMARY OF THE DISCLOSURE

In accordance with one aspect of the disclosure, a winch assembly includes an operator interface movable relative to a neutral position, a sensor configured to determine a position of the operator interface and generate a position signal indicative of a displacement of the operator interface from the neutral position, a rotatable drum, and a brake operably coupled to the drum, the brake having a braking mode, in which the brake engages the drum, and a release mode, in which the brake is disengaged from the drum. A hydraulic circuit includes a motor operably coupled to the drum, and a pump fluidly communicating with the motor, the pump having a pumping mode, in which the pump operates to deliver hydraulic fluid to the motor, and an off mode, in which the pump does not operate. A controller is operably coupled to the sensor, the brake, and the pump, the controller including one or more central processing units and one or more memory devices, the one or more memory devices storing instructions that, when executed by the one or more central processing units, cause the controller to receive the position signal from the sensor, operate the brake in the release mode when the position signal exceeds a first position displacement threshold, and operate the pump in the pumping mode when the position signal exceeds a second position displacement threshold, wherein the second position displacement threshold is greater than the first position displacement threshold.

In another aspect of the disclosure that may be combined with any of these aspects, a machine includes an engine and a winch assembly. The winch assembly has an operator interface movable relative to a neutral position in both a lifting direction and a lowering direction, a sensor configured to determine a position of the operator interface and generate a position signal indicative of a displacement of the operator interface from the neutral position, a rotatable drum, a brake operably coupled to the drum, the brake having a braking mode, in which the brake engages the drum, and a release mode, in which the brake is disengaged from the drum. A hydraulic circuit has a motor operably coupled to the drum, and a pump operably coupled to the engine and fluidly communicating with the motor, the pump having a pumping mode, in which the pump operates to deliver hydraulic fluid to the motor, and an off mode, in which the pump does not operate. A controller is operably coupled to the sensor, the brake, and the pump, the controller including one or more central processing units and one or more memory devices, the one or more memory devices storing instructions that, when executed by the one or more central processing units, cause the controller to receive the position signal from the sensor, operate the brake in the release mode when the position signal exceeds a first position displacement threshold in the lowering direction, and operate the pump in the pumping mode when the position signal exceeds a second position displacement threshold in the lowering direction, wherein the second position displacement threshold is greater than the first position displacement threshold.

In another aspect of the disclosure that may be combined with any of these aspects, a method is provided of controlling a winch assembly having an operator interface movable relative to a neutral position, a rotatable drum, a brake operably coupled to the drum having a braking mode and a release mode, a hydraulic motor operably coupled to the drum, and a pump fluidly communicating with the motor and having a pumping mode and an off mode. The method includes determining a position of the operator interface and generating a position signal indicative of a displacement of the operator interface from the neutral position, communicating the position signal to a controller having one or more central processing units and one or more memory devices the one or more memory devices storing instructions that, when executed by the one or more central processing units, cause the controller to operate the brake in the release mode when the position signal exceeds a first position displacement threshold, and operate the pump in the pumping mode when the position signal exceeds a second position displacement threshold, wherein the second position displacement threshold is greater than the first position displacement threshold In another aspect of the disclosure that may be combined with any of these aspects, the motor may operate at a motor speed when the pump is in the pumping mode, and the instructions when executed by the one or more central processing units may further cause the controller to vary the motor speed based on the position signal.

In another aspect of the disclosure that may be combined with any of these aspects, the instructions when executed by the one or more central processing units may further cause the controller to determine a gear ratio command based on the position signal, and in which the motor speed is based on the gear ratio command.

In another aspect of the disclosure that may be combined with any of these aspects, the position signal may be determined as a percentage of a maximum operator interface displacement, the gear ratio command may be determined as a percentage of maximum motor speed, and the instructions when executed by the one or more central processing units may cause the controller to set the gear ratio command at a value less than the position signal.

In another aspect of the disclosure that may be combined with any of these aspects, the pump may have a variable displacement, the motor may have a variable displacement, and the instructions when executed by the one or more central processing units may cause the controller to adjust at least one of the pump variable displacement and the motor variable displacement in response to the gear ratio command.

In another aspect of the disclosure that may be combined with any of these aspects, the first position displacement threshold may be approximately 1% of a maximum displacement position.

In another aspect of the disclosure that may be combined with any of these aspects, the second position displacement threshold may be approximately 5% of the maximum displacement position.

In another aspect of the disclosure that may be combined with any of these aspects, the operator interface may be movable in both a lifting direction and a lowering direction relative to the neutral position, and the first and second position displacement thresholds may be in the lowering direction relative to the neutral position

DETAILED DESCRIPTION

Embodiments of a hydraulic winch system are disclosed for use on a machine, such as a pipelayer. The hydraulic winch system uses a control algorithm that separates brake control from drum rotation to permit fine control of the load position. More specifically, actuation of an operator interface to a first position displacement threshold will release a drum brake but will not activate a hydraulic pump for operating a hydraulic motor coupled to the drum until the operator interface is moved to a second position displacement threshold. During the operating condition when the brake is released but the pump is not operating, the force of a load applied to a cable coupled to the drum may cause the cable to slowly unwind from and rotate the drum due to leakage of hydraulic fluid through the pump and motor, thereby permitting fine control of drum rotation. Additionally, when the pump is activated upon further movement of the operator interface, a speed of the motor may be modulated, such as by a gear ratio command, to permit precise control over lower drum speeds.

Figure 1:
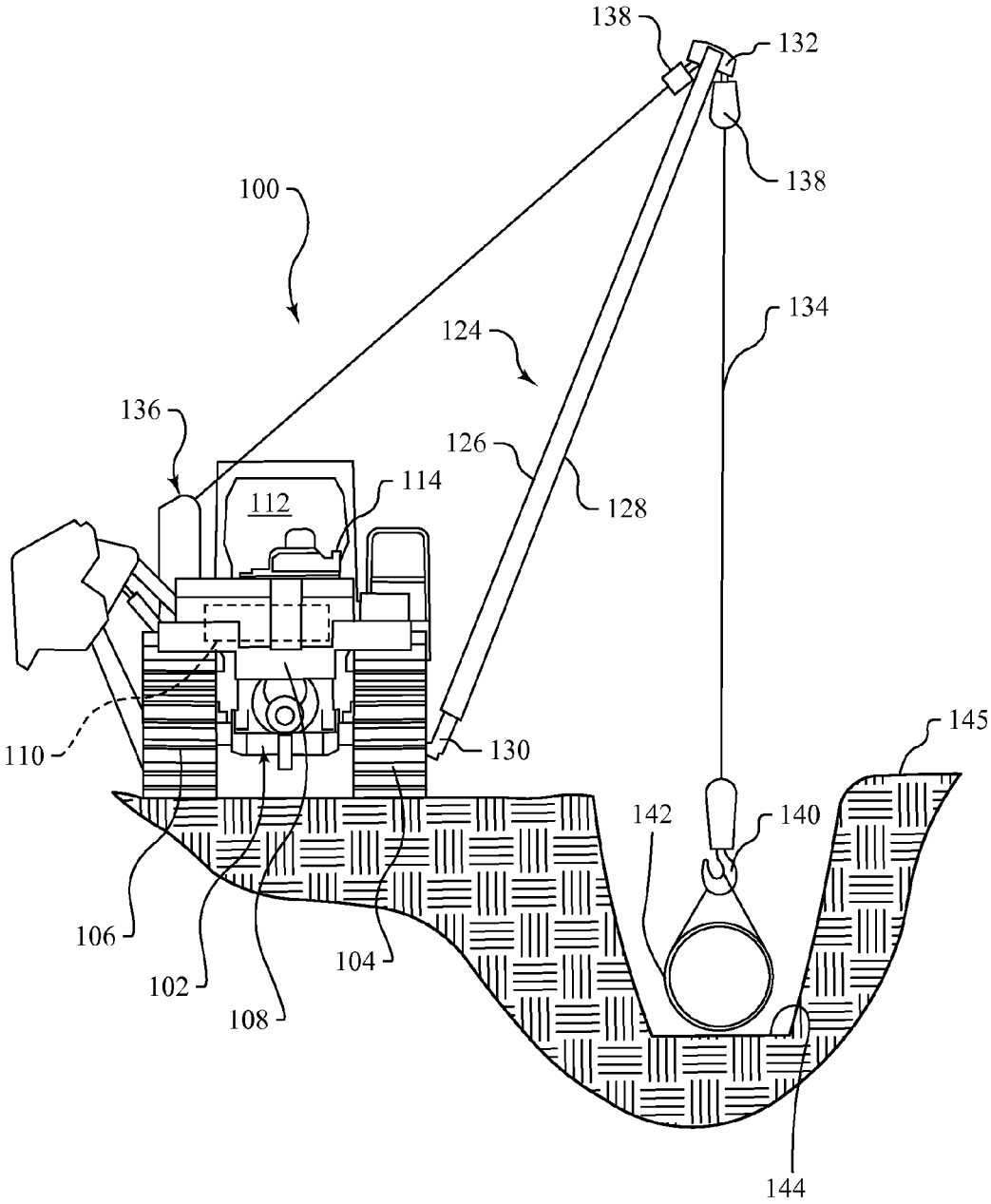
FIG. 1 is a side elevational view of a pipelayer that includes a hydraulic winch system according to aspects of this disclosure.

Referring now to the drawings, and with specific reference to FIG. 1, a winch control system in accordance with the present disclosure is illustrated in connection with a pipelayer 100. While the following detailed description and drawings are made with reference to a pipelayer 100, it is important to note that the teachings of this disclosure can be employed on other earth moving or construction machines including, but not limited to, loaders, back-hoes, lift-trucks, cherry-pickers, forklifts, excavators, or any other fixed or movable machine that may employ a winch.

The pipelayer 100 may include an undercarriage 102 including ground engaging units, such as first and second drive tracks 104, 106, supporting a chassis 108. A power source such as engine 110, which may be a diesel engine, is supported by the chassis 108. A seat 112 and control console 114 may also be supported by the chassis 108 from which the operator can control one or both drive tracks 104 and 106 to drive the pipelayer 100 forward, backward and turn. Each of the drive tracks 104, 106 may be composed of a series of interlinked track shoes in an oval track or high drive configuration, and the tracks may be trained around idlers supported by a track roller frame, sprocket, and other rollers. While the illustrated embodiment shows drive tracks 104, 106, other types of ground engaging units may be used instead of or in addition to the drive tracks 104, 106.

Extending relative to the undercarriage 102 is a boom 124. The boom 124 may include first and second legs 126, 128 (the second leg 128 is obscured by the first leg 126 in the view shown in FIG. 1) independently hinged to the undercarriage 102 at a base 130, and which terminate at a boom tip 132. The boom 124 may be any desired length, with up to twenty-eight or more feet long being suitable. A lifting cable(s) 134 extends from a winch assembly 136 through a series of sheaves 138 at the boom tip 132 and terminates in a hook 140, a vacuum lift (not shown) or other suitable arrangement for wrapping around or otherwise securing a load, such as a pipe 142.

The pipelayer 100 may be navigated by drive tracks 104, 106 to be adjacent a trench 144 pre-dug into ground 145. More precisely, the pipelayer 100 should be positioned away from the trench 144 according to applicable regulations.

Once in such a position, the boom 124 may be extended away from the undercarriage 102 to facilitate positioning the pipe 142 in the trench 144.

Figure 2:
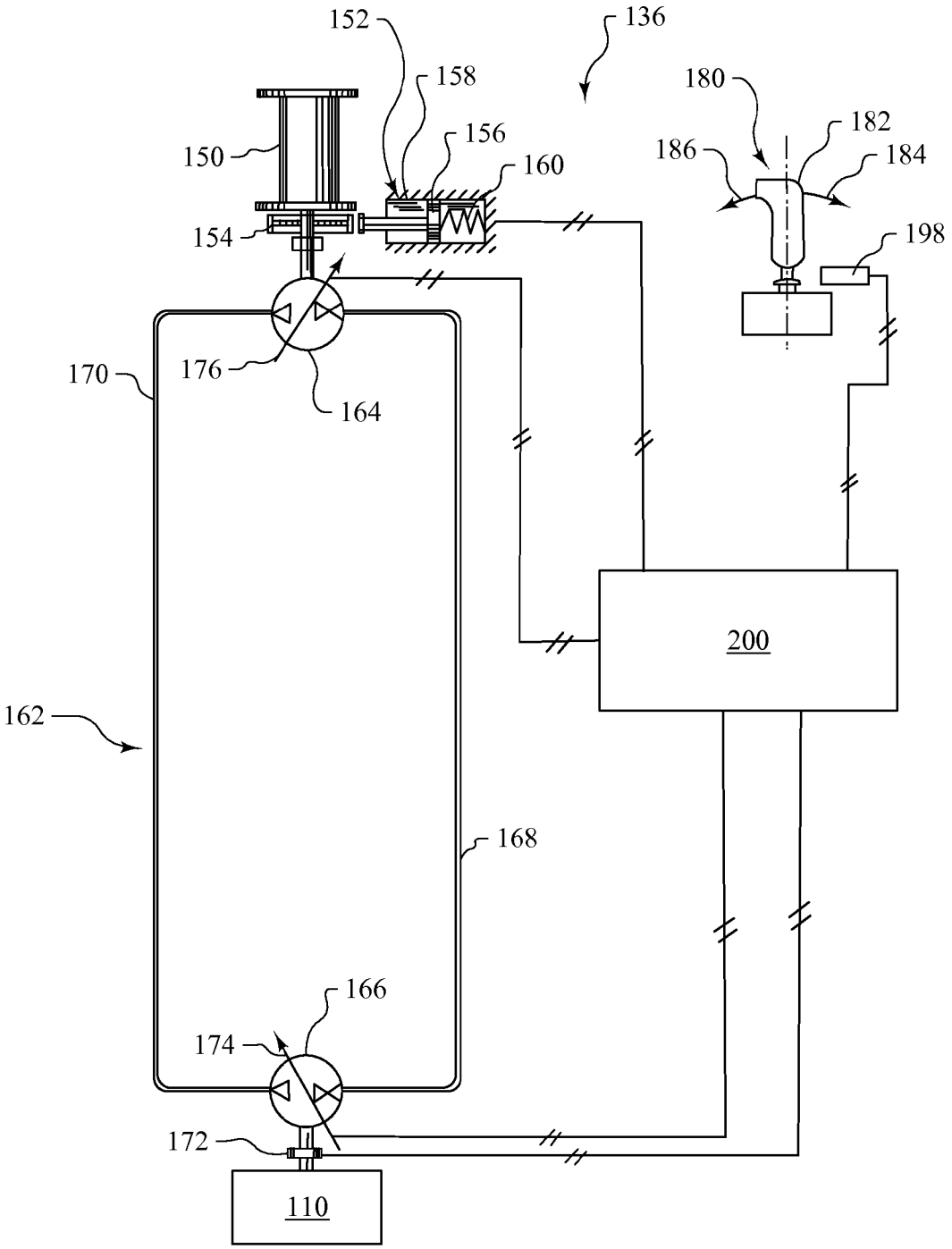
FIG. 2 is a schematic illustration of the hydraulic winch system that may be used in the pipelayer of FIG. 1.

As best shown in FIG. 2 the winch assembly 136 includes a drum 150 that is coupled to the cable 134 and supported for rotation so that the cable 134 may be wound onto or unwound from the drum 150, thereby to raise or lower the hook 140 and attached load. A brake 152 may be provided that has a braking mode in which the brake 152 engages the drum 150 to prevent rotation, and a release mode in which the brake 152 is disengaged from the drum 150 to permit rotation. In the illustrated embodiment, the brake 152 includes a brake disk 154 that is operated by an actuator, such as a braking piston 156 movable in a brake control cylinder 158. A biasing spring 160 may be provided to normally drive the braking piston 156 into the brake disk 154, thereby to move the brake 152 to the braking mode. The braking piston 156 may be moved, such as by hydraulic force, to disengage the brake disk 154, thereby moving the brake 152 to the release mode. The brake 152 described herein is merely exemplary, as other types of brake arrangements may be used without departing from the scope of the present disclosure.

The winch assembly 136 may also include a hydraulic circuit 162 for driving the drum 150. As best shown in FIG. 2, the hydraulic circuit 162 may include a motor 164 operatively coupled to the drum 150. A pump 166 fluidly communicates with the motor 164, such as through a discharge line 168 and a return line 170. The pump 166 may further be mechanically coupled, such as through a clutch 172, to a prime mover, such as the engine 110. The pump 166 may have a pumping mode, in which the pump 166 operates to deliver hydraulic fluid through the discharge line 168, thereby to operate the motor 164. The pump 166 may also have an off mode, during which the pump 166 does not operate. In pump mode, the clutch 172 may be engaged to transfer mechanical energy from the engine 110 to the pump 166, while in off mode the clutch 172 may be disengaged so that the pump 166 does not receive mechanical energy from the engine 110.

The motor 164 is operable at different motor speeds to drive the drum 150 at different rotational speeds. For example, motor speed may vary with the rate of hydraulic fluid flow through the discharge line 168. In an exemplary embodiment, the pump 166 may be a variable displacement pump having a displacement volume that may be adjusted, such as by pump swage 174, to generate different hydraulic fluid flow rates. For example, the hydraulic fluid flow rate may increase when the pump variable displacement is increased by moving the pump swage 174 in a first direction, and the fluid flow rate may decrease when the pump variable displacement is decreased by moving the pump swage 174 in a second, opposite direction. The motor 164 may be responsive to the hydraulic fluid flow rate to increase motor speed when the hydraulic fluid flow rate increases and to decrease motor speed when the hydraulic fluid flow rate decreases. Additionally or alternatively, the motor 164 may be a variable displacement motor having a displacement volume that is adjustable, such as by motor swage 176, to generate different motor speeds for a given hydraulic fluid flow rate. Motor speed may be inversely proportional to motor displacement volume. For example, when the motor variable displacement decreases, the motor speed will increase for a constant hydraulic fluid flow rate input. Conversely, when motor variable displacement increases, the motor speed will decrease for a constant hydraulic fluid flow rate input. In one embodiment of a motor speed control scheme, in the lower portion of the motor speed range, changes in motor speed may be accomplished by adjusting only the pump displacement volume. Once pump displacement volume has been maximized, motor speed changes in the upper portion of the motor speed range may be accomplished by adjusting only the motor displacement volume. This motor speed control scheme is merely exemplary, as other control schemes may be used without departing from the scope of the present disclosure.

An operator interface 180 may be provided for entering user inputs to the winch assembly 136. The operator interface 180 may be any known mechanism or device used to convey an operator's commands to a machine, including, for example, so-called joystick operation. While the seat 112 and control console 114 are shown in the illustrated embodiments, the inclusion of such a seat 112 and control console 114 are optional in that the pipelayer 100 could alternately be autonomous, that is, the pipelayer 100 may be remotely controlled by a control system that does not require operation by an on-board human operator.

Figure 3:
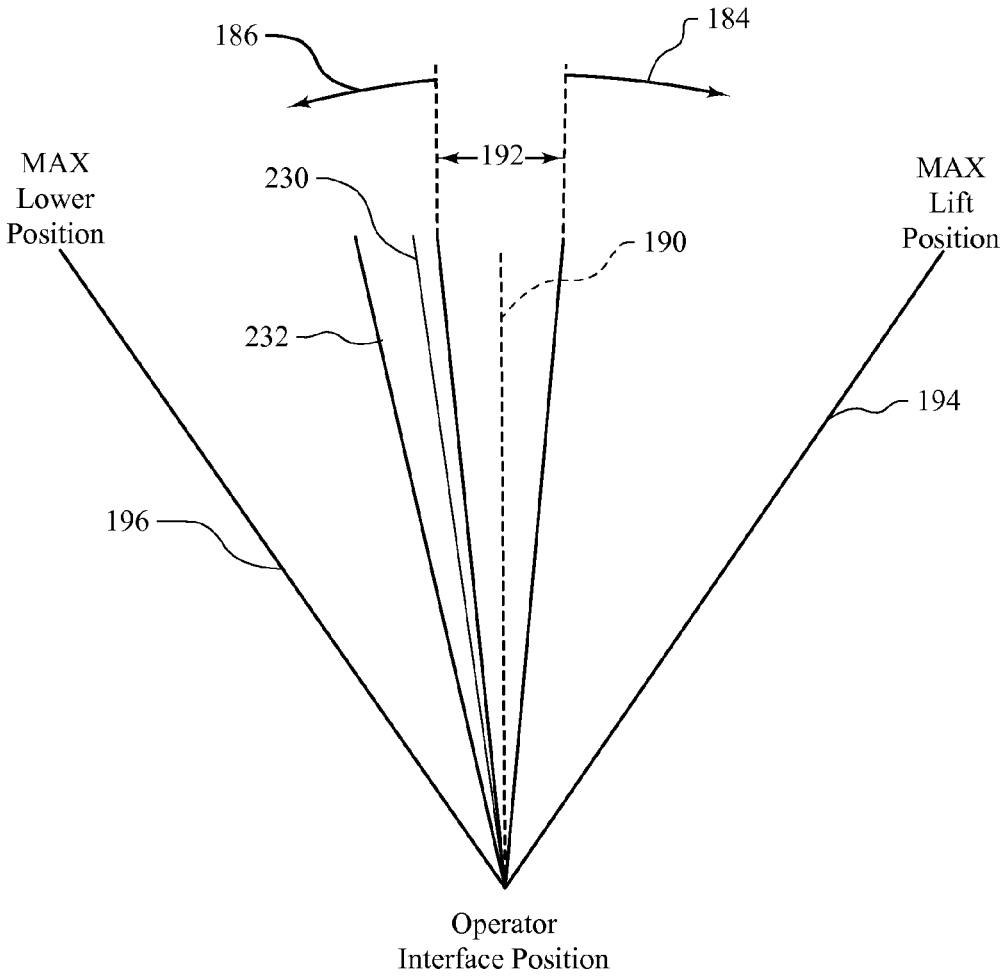
FIG. 3 is a schematic illustration of a range of motion of an operator interface that may be used in the hydraulic winch system of FIG. 2.

In an exemplary embodiment, the operator interface 180 may include a lever 182 that may be moved in either a lifting direction 184 or a lowering direction 186 relative to a neutral position of the lever 182. The neutral position may be the position the lever 182 assumes when it is not engaged by the operator. As schematically shown in FIG. 3, a central axis 190 may extend through a center of the range of motion of the lever 182 that defines the neutral position. Additionally, the operator interface 180 may be configured to have a dead band 192 surrounding the central axis 190 in which slight displacement from the central axis 190 may still be considered to be the neutral position, thereby to minimize inadvertent operation of the winch assembly 136. Displacement of the lever 182 past the dead band 192 indicates that winch operation is desired in one of the lifting and lowering directions 184, 186. The range of travel of the lever 182 is bounded by a first maximum displacement position 194 in the lifting direction 184 and a second maximum displacement position 196 in the lowering direction 186.

As best shown in FIG. 2, the winch assembly 136 may further include a position sensor 198. The position sensor 198 may be operatively coupled to the operator interface 180 and configured to determine a position of the operator interface 180 and generate a position signal indicative of a displacement of the operator interface 180 from the neutral position. One or more filters may be operatively coupled to the position sensor 198 to condition the position signal as desired. For example, the filters may be low pass filters that filter out high frequency jitter provided by the position sensor 198, thereby filtering out very rapid movements of the lever 182. The filters may be implemented in hardware using one of any number of conventional filtering techniques. Additionally or alternatively, the filters may be implemented in the software associated with a controller that receives the position signal.

Figure 4:
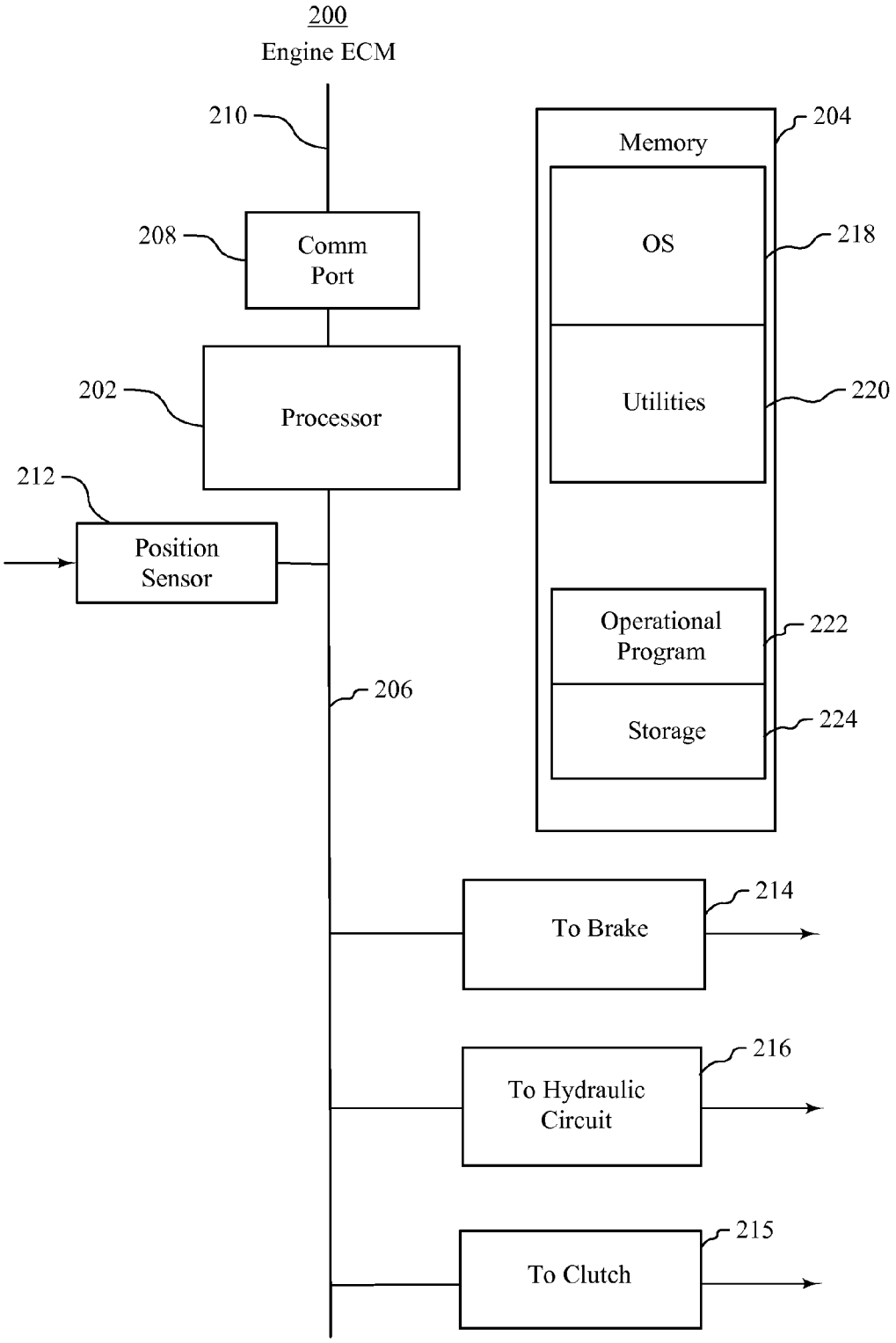
FIG. 4 is a simplified and exemplary block diagram illustrating components of a controller used to operate the components of the hydraulic winch system.

FIG. 4 illustrates an exemplary controller 200 that is operatively coupled to the brake 152, the pump 166, the motor 164, the clutch 172, and the position sensor 198. The controller 200 may include one or more central processing units 202 and one or more memory devices 204 connected by a bus 206. The one or more central processing units 202 may be any of a number of known computer processor architectures, including, but not limited to, single chip processors or conventional computer architectures. The one or more memory devices 204 may include non-transitory memory media, and may be provided as any combination of volatile and non-volatile memory, including rotating media, flash memory, conventional RAM, ROM or other non-volatile programmable memory. The one or more memory devices 204 may store instructions that may be executed by the one or more central processing units 202. The controller 200 may also include a communication port 208 providing support for communication with external devices, such as an engine computer or radio for communication with an external system, via a network 210.

A series of sensor inputs may be coupled to the bus 206. Each sensor input may have a common configuration but in some cases may be tailored to a particular sensor type and may provide specific conversion or conditioning based on the sensor to which it is coupled. For example, a sensor input coupled to an analog device may provide an analog-to-digital conversion. In an embodiment, sensor inputs may include a position sensor input 212. Several outputs may also be provided, including but not limited to, an output 214 that drives the brake 152, an output 215 that controls pump operation, and an output 216 that controls motor speed.

The one or more memory devices 204 may include storage for various aspects of operation of the controller 200 including various modules implementing an operating system 218, utilities 220, and operational programs 222, as well as short-term and long-term storage 224 for various settings and variables used during operation. The operational programs 222 may include a number of modules that perform functions described below. Such modules may include, but are not limited to, an input module that receives data corresponding to displacement of the operator interface 180 from the neutral position, a performance module that determines when the displacement of the operator interface 180 exceeds a first position displacement threshold to command disengagement of the brake 152, a performance module that determines when the displacement of the operator interface 180 exceeds a second threshold to initiate operation of the pump 166, and a performance module that modulates motor speed based on operator interface position.

The controller 200 may receive data from the position sensor 198 indicative of a displacement of the operator interface 180 from the neutral position. The range of motion of the operator interface 180 may be expressed as a percentage of the first maximum displacement position 194 in the lifting direction 184 and as a percentage of the second maximum displacement position 196 in the lowering direction 186, so that the position data may be normalized between 0 and 100% in each direction. In the lowering direction 186, for example, the position data indicating that the operator interface 180 has been moved to a position at which load movement is initially requested (i.e., is displaced from the neutral position or has been moved outside of the dead band 192) may be mapped to 1% of operator interface displacement, and movement to the second maximum displacement position 196 may be mapped to 100%.

The controller 200 may be configured to operate the brake 152 in the release mode when the position signal exceeds a first position displacement threshold 230 (FIG. 3). When the operator interface 180 is in the neutral position, the brake 152 is in the braking mode to prevent drum rotation and the pump 166 is in the off mode. Displacement of the operator interface 180 from the neutral position indicates that movement of the load is desired. When that displacement is in the lowering direction 186, the controller 200 may control the brake 152 to move from the braking mode to the release mode, thereby disengaging the brake 152 from the drum 150, while maintaining the pump 166 in the off mode. With the brake 152 in the release mode and the pump 166 in the off mode, the drum 150 may slowly rotate in response to the load attached to the cable 134. The speed at which the drum 150 rotates in these operating conditions is based on the amount of hydraulic fluid leakage through the pump 166 and motor 164. As a result, the cable 134 may be lowered at a slow rate of speed when the first position displacement threshold 230 is met, thereby permitting fine control of load position. The first position displacement threshold 230 may be selected relatively near the neutral position, such as the point at which drum rotation is initially requested. For example, the first position displacement threshold 230 may be selected at approximately 1% of the second maximum displacement position 196.

The controller 200 may also be configured to operate the pump 166 in the pumping mode when the position signal exceeds a second position displacement threshold 232. Prior to reaching the second position displacement threshold 232, the pump 166 is in the off mode and the brake 152 is in the release mode, as described above. Additional displacement of the operator interface 180 will eventually reach the second position displacement threshold 232, at which time the controller 200 switches the pump 166 to the pumping mode. In an exemplary embodiment, the switch from off mode to pumping mode may be effected by engaging the clutch 172, however other known means may be used to change the operating mode of the pump 166. With the pump 166 in pumping mode, the speed of drum rotation will increase, reducing the precision with which load position may be controlled. The second position displacement threshold 232 may be selected relatively farther from the neutral position, such as at approximately 5% of the second maximum displacement position 196. By separating the points at which the operator interface displacement initiates brake release and pump operation, finer load position control can be achieved at the lower range of operator interface displacement.

Still further, the controller 200 may be configured to modulate motor speed to permit finer drum rotation speed control. When the pump is in the pumping mode, the motor 164 operates at a motor speed. The controller 200 may be configured to vary the motor speed based on the position signal, such that increased displacement of the operator interface 180 will increase the motor speed. In an exemplary embodiment, the controller 200 may be programmed to determine a gear ratio command based on the position signal, and the motor speed may be based on the gear ratio command. At least one of the pump displacement and the motor displacement may be adjusted in response to the gear ratio command to achieve the desired motor speed. The gear ratio command may be expressed as a percentage of maximum motor speed. To permit finer control of drum speed, the gear ratio command may be set at a value less than the corresponding position signal. For example, when the position signal indicates that the operator interface 180 is at 10% of the second maximum displacement position 196, the gear ratio command may be set at less than 10% of maximum motor speed. Table 1 below provides an exemplary chart of operator interface positions expressed as a percentage of maximum operator interface position and associated gear ratio commands expressed as a percentage of maximum motor speed, as the operator interface 180 is moved in the lowering direction 186:

TABLE 1

| Gear Command Ratio for Associated Operator Interface Positions: Operator Interface Moving in Lowering Direction | | | | | | | | | | | | |
|---|---|---|---|---|---|---|---|---|---|---|---|---|
| | Operator Interface Position | | | | | | | | | | | |
| | 100% | 90% | 80% | 70% | 60% | 50% | 40% | 30% | 20% | 10% | 5% | 0% |
| Gear Command Ratio | 100% | 85% | 70% | 54% | 39% | 24% | 12% | 5.1% | 3.2% | 1.6% | 0% | 0% |

As will be noted from the above chart, only the maximum operator interface position (i.e., 100%) has an equal gear command ratio value. At each operator interface position below the maximum, the gear command ratio is less than the associated operator interface position. Also, the gear command ratio reaches 0% when the operator interface position is 5%, to reflect the separation of brake release and pump operation discussed above.

INDUSTRIAL APPLICABILITY

The present disclosure is applicable to machines that use a winch assembly having an operator interface for controlling position of a load attached to the winch assembly. In the exemplary pipelayer, the winch assembly controller permits more fine and precise control of load position when lowering is initiated by separating the point at which the brake is released and the point at which pump operation is initiated. As a result, very slow winch drum speeds can be achieved. Additionally, the controller may control motor speed by determining a gear ratio command based on operator interface position. Still further, the present winch device streamlines the hydraulic circuit by eliminating the need for a counterbalance valve, reducing the amount of heat generated in the hydraulic circuit and requiring less flushing of the hydraulic circuit.

Figure 5:
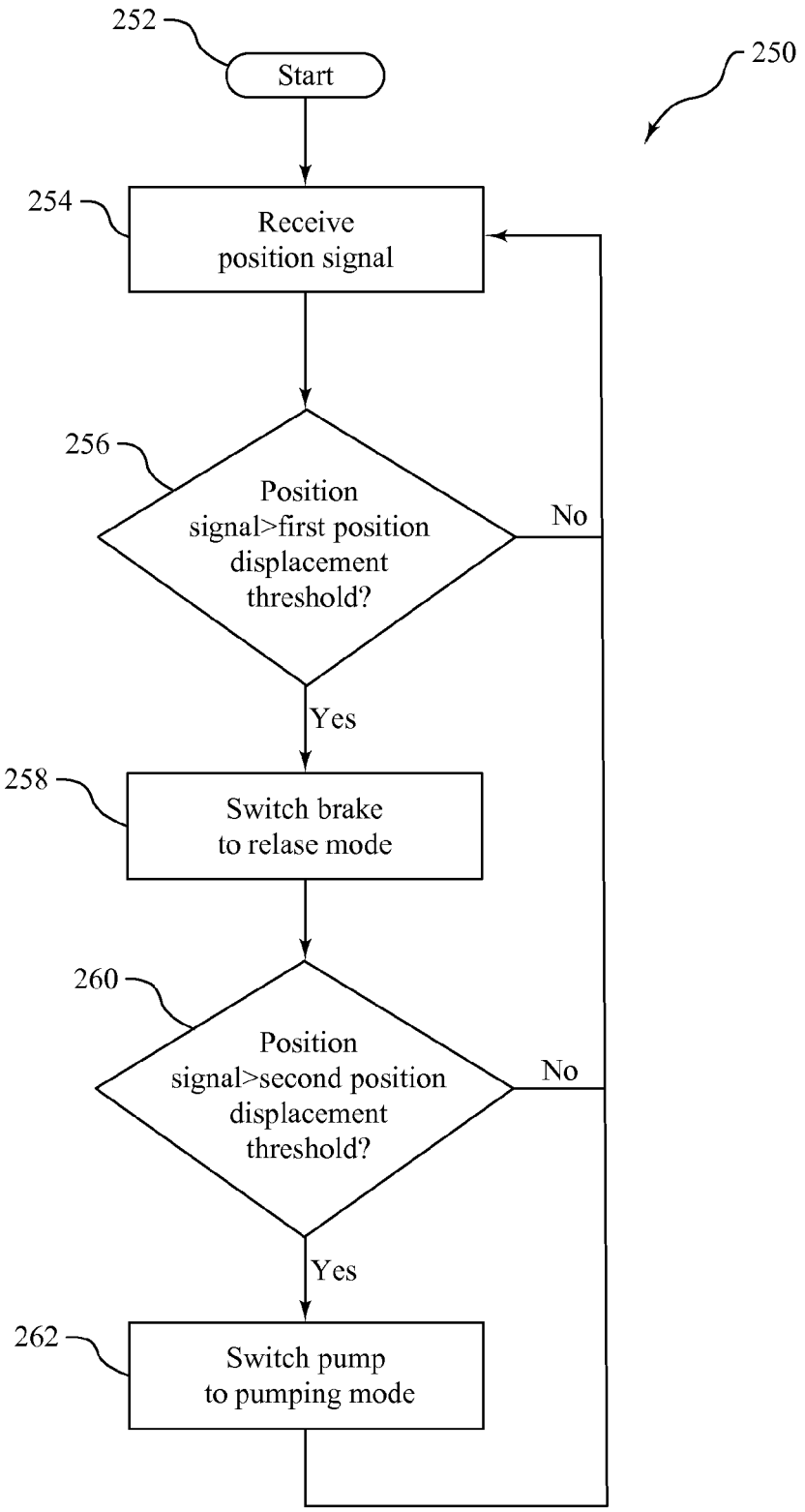
FIG. 5 is a flow chart illustrating a method of controlling operation of the hydraulic winch system.

FIG. 5 is a flowchart illustrating a method 250 of controlling the winch assembly 136 to provide fine control over load position as the operator interface 180 is moved from a neutral position. A goal of this process is to provide discrete operator interface positions that sequentially trigger brake release and pump activation when using the winch to lower a load. After starting at block 252, the position signal is received and conditioned, as required, to determine a position of the operator interface 180 at block 254. The position signal may be communicated by the position sensor 198 and may be indicative of displacement of the operator interface 180 from the neutral position. Input conditioning may involve input value conversion, such as converting analog signals to digital signals, protocol conversions, such as 4-20 ma sensor input conversion, or scaling of input values for easier use in subsequent calculations.

The method 250 continues at block 256, where the controller 11 determines whether the position signal exceeds a first position displacement threshold 230. If the position signal is less than the first position displacement threshold 230, the brake 152 remains in the braking mode and the pump 166 remains in the off mode and the method 250 returns to block 254. If, however, the position signal exceeds the first position displacement threshold 230, the brake 152 is switched to the release mode while the pump 166 remains in the off mode, as shown at block 258. Under these operating conditions, leakage through the pump 166 and motor 164 permits slow rotation of the drum 150.

At block 260, the method 250 includes determining whether the position signal exceeds a second position displacement threshold 232. If the position signal is less than the second position displacement threshold 232, the pump 166 remains in the off mode and the method returns to block 254. Otherwise, if the position signal exceeds the second position displacement threshold 232, the pump 166 is switched to the pumping mode at block 262 to increase the rate at which the drum 150 rotates, and the method returns to block 254 to continue monitoring the position signal. While the method 250 is illustrated as a continuous loop, it will be appreciated that the method may include one or more exit points based on operator input or operating conditions. For example, the method 250 may exit when the pipelayer 100 and/or winch assembly 136 is powered off, when the brake 152 is re-engaged, or when the pump 166 is deactivated.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A winch assembly comprising:

an operator interface movable relative to a neutral position;

a sensor configured to determine a position of the operator interface and generate a position signal indicative of a displacement of the operator interface from the neutral position;

a rotatable drum;

a brake operably coupled to the rotatable drum, the brake having a braking mode and a release mode, wherein the brake engages the rotatable drum in the braking mode, and wherein the brake is disengaged from the rotatable drum in the release mode;

a hydraulic circuit including:

a motor operably coupled to the rotatable drum; and a pump fluidly communicating with the motor, the pump having a pumping mode, wherein the pump operates to deliver hydraulic fluid to the motor, and an off mode, wherein the pump does not operate;

a controller operably coupled to the sensor, the brake, and the pump, the controller including one or more central processing units and one or more memory devices, the one or more memory devices storing instructions that, when executed by the one or more central processing units, cause the controller to:

receive the position signal from the sensor;

operate the brake in the braking mode and the pump in the off mode when the operator interface is in the neutral position;

determine if the displacement of the operator interface exceeds a first position displacement threshold;

determine if the displacement of the operator interface exceeds a second position displacement threshold that is greater than the first position displacement threshold;

operate the brake in the release mode while maintaining the pump in the off mode when the position signal exceeds the first position displacement threshold but is less than the second position displacement threshold; and operate the pump in the pumping mode while maintaining the brake in the release mode when the position signal exceeds the second position displacement threshold.

2. The winch assembly of claim 1, wherein the motor operates at a motor speed when the pump is in the pumping mode, and the instructions, when executed by the one or more central processing units, further cause the controller to vary the motor speed based on the position signal.

3. The winch assembly of claim 2, wherein the instructions, when executed by the one or more central processing units, further cause the controller to determine a gear ratio command based on the position signal, and wherein the motor speed is based on the gear ratio command.

4. The winch assembly of claim 3, wherein:

the position signal is determined as a percentage of a maximum operator interface displacement;

the gear ratio command is determined as a percentage of maximum motor speed; and the instructions, when executed by the one or more central processing units, cause the controller to set the gear ratio command at a value less than the position signal.

5. The winch assembly of claim 3, wherein:

the pump has a pump variable displacement;

the motor has a motor variable displacement; and the instructions, when executed by the one or more central processing units, cause the controller to adjust at least one of the pump variable displacement or the motor variable displacement based on the gear ratio command.

6. The winch assembly of claim 1, wherein the first position displacement threshold is approximately 1% of a maximum displacement position.

7. The winch assembly of claim 6, wherein the second position displacement threshold is approximately 5% of the maximum displacement position.

8. The winch assembly of claim 1, wherein:

the operator interface is movable in both a lifting direction and a lowering direction relative to the neutral position; and the first and second position displacement thresholds are in the lowering direction relative to the neutral position.

9. A machine comprising:

an engine;

a winch assembly, including:

an operator interface movable relative to a neutral position in both a lifting direction and a lowering direction;

a sensor configured to determine a position of the operator interface and generate a position signal indicative of a displacement of the operator interface from the neutral position;

a rotatable drum;

a brake operably coupled to the rotatable drum, the brake having a braking mode, and a release mode, wherein the brake engages the rotatable drum in the braking mode, and wherein the brake is disengaged from the rotatable drum in the release mode;

a hydraulic circuit having a motor operably coupled to the rotatable drum, and a pump operably coupled to the engine and fluidly communicating with the motor, the pump having a pumping mode, wherein the pump operates to deliver hydraulic fluid to the motor, and an off mode, wherein the pump does not operate;

a controller operably coupled to the sensor, the brake, and the pump, the controller including one or more central processing units and one or more memory devices, the one or more memory devices storing instructions that, when executed by the one or more central processing units, cause the controller to:

receive the position signal from the sensor;

operate the brake in the braking mode and the pump in the off mode when the operator interface is in the neutral position;

determine if the displacement of the operator interface exceeds a first displacement threshold in the lowering direction;

determine if the displacement of the operator interface exceeds a second position displacement threshold in the lowering direction that is greater than the first position displacement threshold;

operate the brake in the release mode while maintaining the pump in the off mode when the position signal exceeds the first position displacement threshold but is less than the second position displacement threshold; and operate the pump in the pumping mode while maintaining the brake in the release mode when the position signal exceeds the second position displacement threshold.

10. The machine of claim 9, wherein the motor operates at a motor speed when the pump is in the pumping mode, and the instructions, when executed by the one or more central processing units, further cause the controller to vary the motor speed on the position signal.

11. The machine of claim 10, wherein the instructions, when executed by the one or more central processing units, further cause the controller to determine a gear ratio command based on the position signal, and wherein the motor speed is based on the gear ratio command.

12. The machine of claim 11, wherein:

the position signal is determined as a percentage of a maximum operator interface displacement;

the gear ratio command is determined as a percentage of maximum motor speed; and the instructions, when executed by the one or more central processing units, cause the controller to set the gear ratio command at a value less than the position signal.

13. The machine of claim 9, wherein the first position displacement threshold is approximately 1% of a maximum displacement position.

14. The machine of claim 13, wherein the second position displacement threshold is approximately 5% of the maximum displacement position.

15. A winch assembly comprising:

an operator interface movable relative to a neutral position in both a lifting direction and a lowering direction;

a sensor operatively coupled to the operator interface, the sensor configured to determine a position of the operator interface and generate a position signal indicative of a displacement of the operator interface from the neutral position;

a rotatable drum;

a brake operably coupled to the rotatable drum, the brake having a braking mode and a release mode, wherein the brake engages the rotatable drum in the braking mode, and wherein the brake is disengaged from the rotatable drum in the release mode;

a hydraulic circuit including:

a motor operably coupled to the rotatable drum; and a pump fluidly communicating with the motor, the pump having:

a pumping mode, wherein the pump operates to deliver hydraulic fluid to the motor, and an off mode, wherein the pump does not operate;

a controller operably coupled to the sensor, the brake, and the pump, the controller including one or more central processing units and one or more memory devices, the one or more memory devices storing instructions that, when executed by the one or more central processing units, cause the controller to:

receive, from the sensor, the position signal indicative of the displacement of the operator interface from the neutral position;

operate the brake in the braking mode and the pump in the off mode when the operator interface is in the neutral position;

determine if the displacement of the operator interface exceeds a first position displacement threshold in the lowering direction;

determine if the displacement of the operator interface exceeds a second position displacement threshold in the lowering direction that is greater than the first position displacement threshold;

operate the brake in the release mode while maintaining the pump in the off mode when the position signal exceeds the first position displacement threshold but is less than the second position displacement threshold; and operate the pump in the pumping mode while maintaining the brake in the release mode when the position signal exceeds the second position displacement threshold.

16. The winch assembly of claim 15, wherein the operator interface includes a lever movable in the lifting direction and the lowering direction relative to the neutral position, a range of travel of the lever being bounded by a first maximum displacement position in the lifting direction and a second maximum displacement position in the lowering direction.

17. The winch assembly of claim 16, wherein the first position displacement threshold is selected relatively near the neutral position, and wherein the second position displacement threshold is selected relatively farther from the neutral position.

18. The winch assembly of claim 17, wherein the first position displacement threshold is selected at approximately 1% of the second maximum displacement position, and wherein the second position displacement threshold is selected at approximately 5% of the second maximum displacement position.

19. The winch assembly of claim 18, further comprising at least one low pass filter operatively coupled to the sensor to filter out high frequency jitter on the position signal.

20. The winch assembly of claim 19, wherein the motor operates at a motor speed when the pump is in the pumping mode, and wherein the controller is configured to vary the motor speed based on the position signal.

* * * * *